United States Patent [19]

Lest

[11] Patent Number: 4,554,442

[45] Date of Patent: Nov. 19, 1985

[54] ALIQUOT PART LOCATOR

[75] Inventor: William L. Lest, San Francisco, Calif.

[73] Assignee: The United States of America as represented by the Secretary of Agriculture, Washington, D.C.

[21] Appl. No.: 694,554

[22] Filed: Jan. 24, 1985

[51] Int. Cl.[4] ..... G06C 3/00

[52] U.S. Cl. ..... 235/88 R

[58] Field of Search ..... 235/78 R–78 M, 235/88 R–89 R

[56] References Cited

U.S. PATENT DOCUMENTS 3,289,324 12/1966 Benson ..... 235/78 M 3,718,519 2/1973 Montgomery ..... 235/78 R X 3,764,065 10/1973 Plumly ..... 235/88 R

*Primary Examiner*—Benjamin R. Fuller

*Attorney, Agent, or Firm*—M. Howard Silverstein; David G. McConnell

[57] ABSTRACT

An aliquot part subdivision locator assigns reference numerals to each of 64, (or other power of 4) subdivisions of a square representing an aliquot part or an aliquot part subdivision. A chart matches each subdivision's label with a reference numeral, and two labelled discs having holes therein are set with a reference numeral aligned. When a reference numeral of the lower disc is aligned with the same reference numeral on the upper disc, and when both discs are at a predetermined angle relative to a randomly chosen radius, the aligned reference numeral appear through the holes at the appropriate position of a map in front of both discs.

4 Claims, 10 Drawing Figures

FIG.1
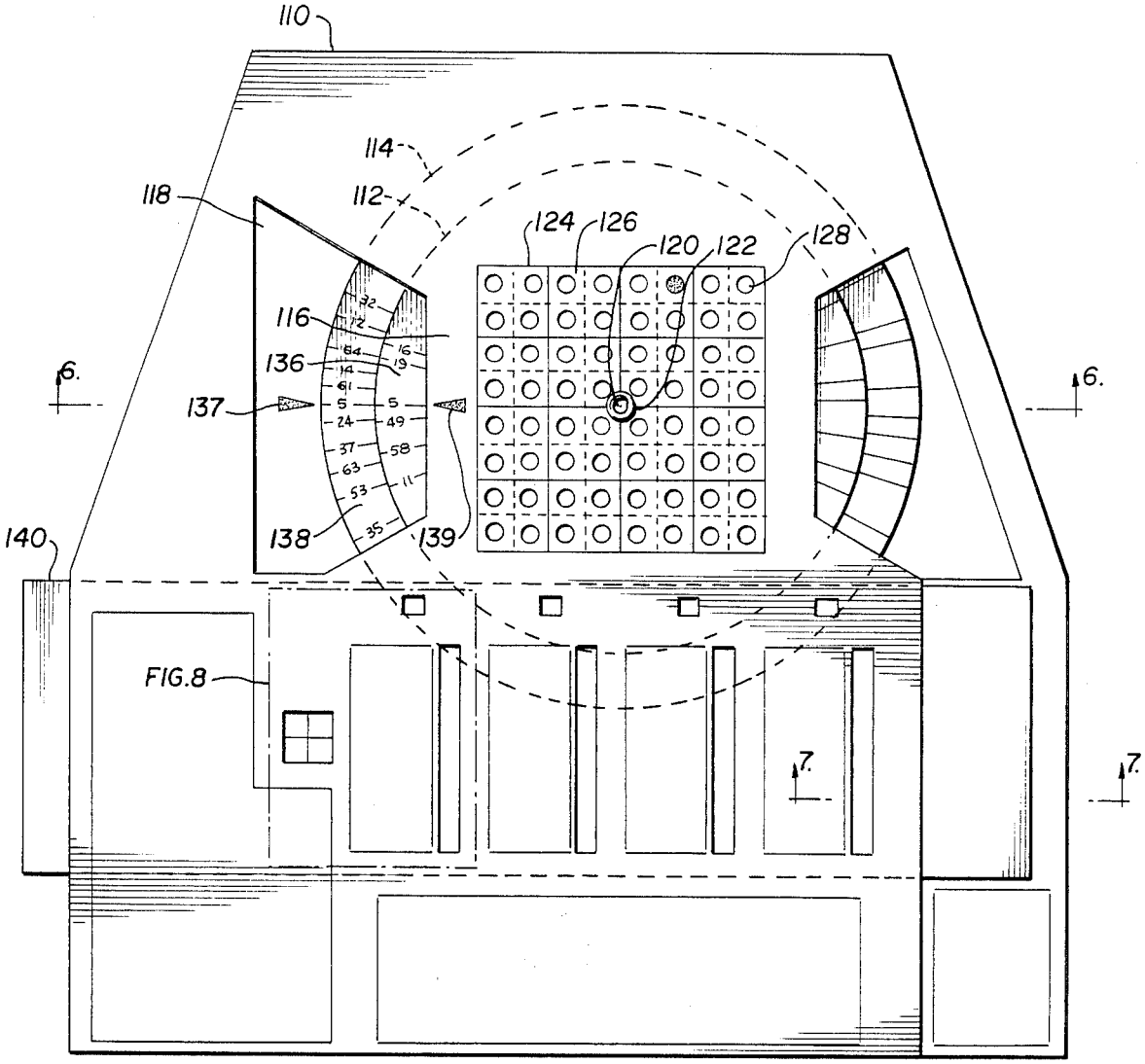
FIG.3
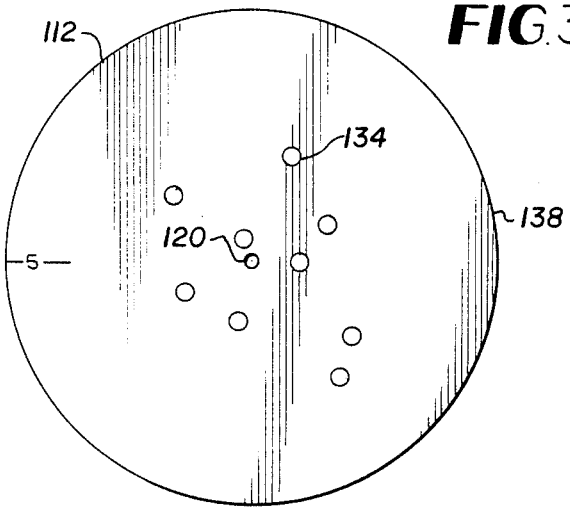
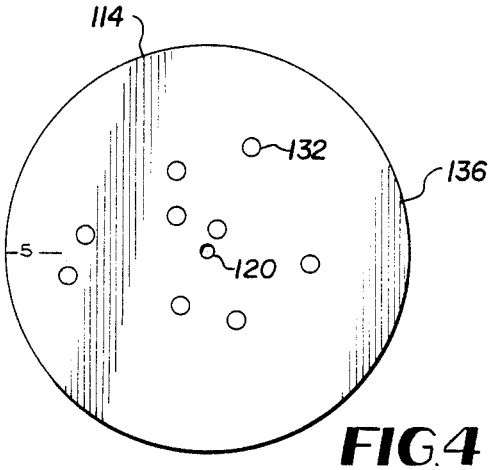
FIG.4

FIG. 2
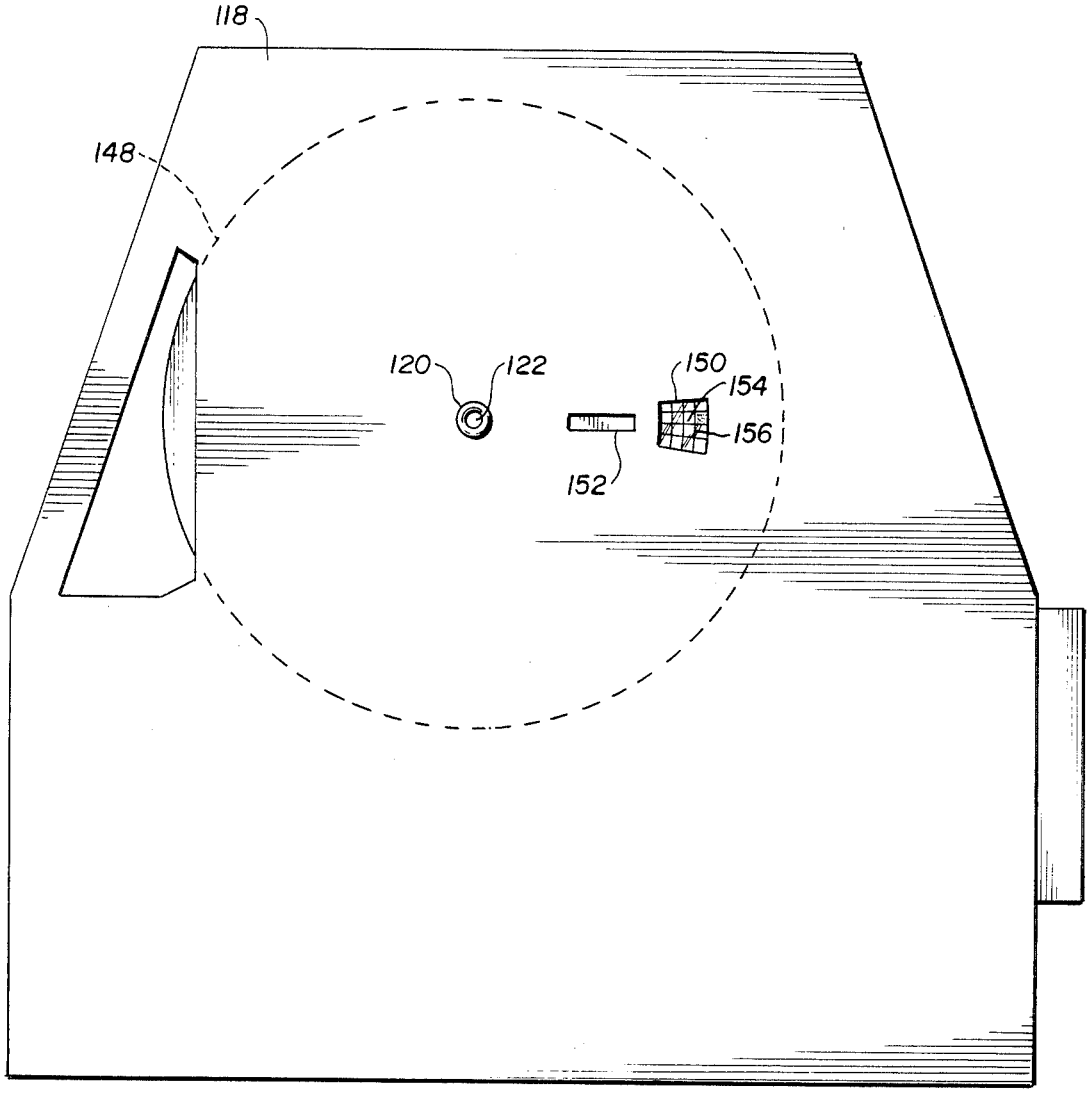
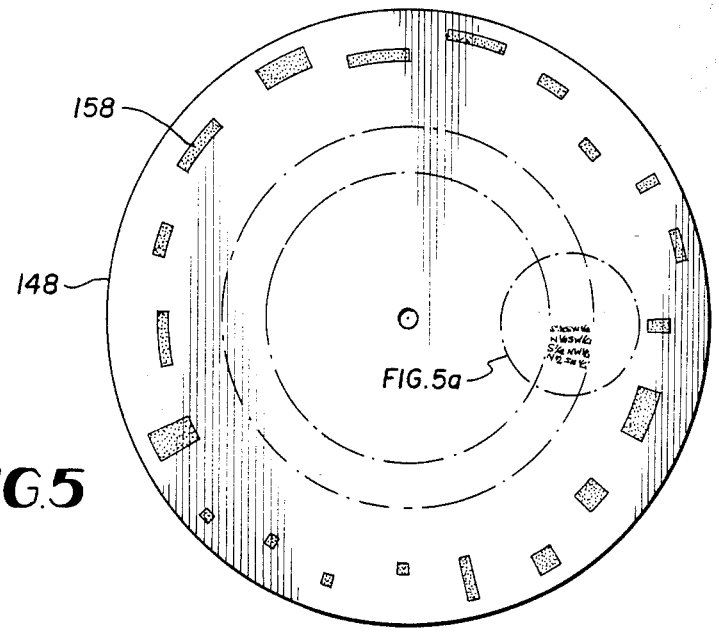
FIG. 5
FIG. 5a
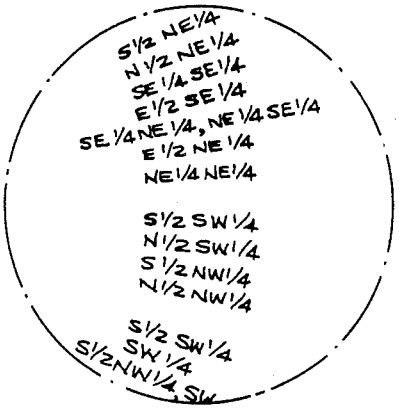

ALIQUOT PART LOCATOR

FIELD OF THE INVENTION

This invention relates in general to the locating of aliquot part land subdivisions and in particular to the locating of aliquot part land subdivisions for those lands within the Public Lands Survey System of Townships and Ranges.

BACKGROUND OF THE INVENTION

Public lands are typically divided into aliquot parts by quarters. That is, each equilateral or square-shaped land section is divided into four squares of equal area, and each square assigned the label NE$\frac{1}{4}$, NW$\frac{1}{4}$, SE$\frac{1}{4}$, or SW$\frac{1}{4}$, depending on its location. These four squares are then further subdivided into four equal-sized squares which are again labelled as above. This process of subdividing and labelling may be carried out ad infinitum, but is usually carried out on 640 acre plots until the plot is divided into 2$\frac{1}{2}$ acre aliquots. Thus, each 2$\frac{1}{2}$ acre aliquot part has four labels, for example, NE $\frac{1}{4}$ NE $\frac{1}{4}$ SW $\frac{1}{4}$ NE $\frac{1}{4}$, the label of the largest subdivision being the last listed.

Such a system, while highly functional, makes the location of any aliquot part a complex process. Mistakes can and do occur. It is especially difficult for trainees to locate aliquot parts of a plot of land. Thus, there is a need for both a device assisting in the locating of aliquot part subdivisions and a device for training people to locate aliquot part subdivisions.

SUMMARY OF THE INVENTION

It is a purpose of this invention to provide an educational device for training people to locate aliquot part subdivisions.

It is another purpose of this invention to provide a device to assist in the locating of aliquot part subdivisions.

It is a further purpose of this invention to provide a device to reduce mistakes in the locating of an aliquot part subdivision.

These and other objects are achieved by a device assigning reference numerals to each of 64 (or other number which is a power of 4) subdivisions of a square representing an aliquot part or an aliquot part subdivision. A chart matches each subdivision's label with a reference numeral, and two labelled discs having holes therein are set with a reference numeral aligned. When a reference numeral of the outer disc is aligned with the same reference numeral on the inner disc, and when both discs are at a predetermined angle relative to a randomly chosen radius, the aligned reference numeral appears through the hole in the discs at the appropriate position of a map positioned in front of both discs.

BRIEF DESCRIPTION OF THE DRAWINGS

FIG. 1 shows a plan view of the front side of a preferred embodiment of the present invention.

FIG. 2 shows a plan view of the reverse side of the preferred embodiment of the present invention.

FIG. 3 shows a plan view of the front side of the lower rotatable disc of the preferred embodiment of the present invention.

FIG. 4 shows a plan view of the front side of the upper rotatable disc of the preferred embodiment of the present invention.

FIG. 5 shows a plan view of the back side of an innermost rotatable disc of the preferred embodiment of the present invention.

FIG. 5*a* is a magnification of a portion of FIG. 5 as indicated in FIG. 5.

DETAILED DESCRIPTION OF THE INVENTION

Figure 6:
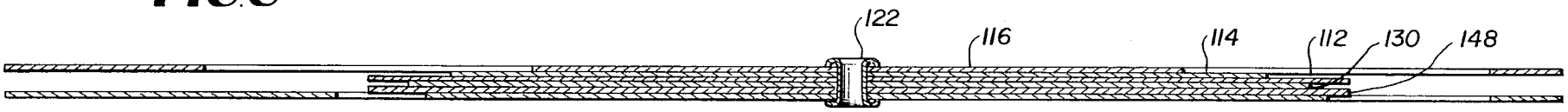
FIG. 6 is a cross-section taken along line 6—6 of FIG. 1.
Figure 8:
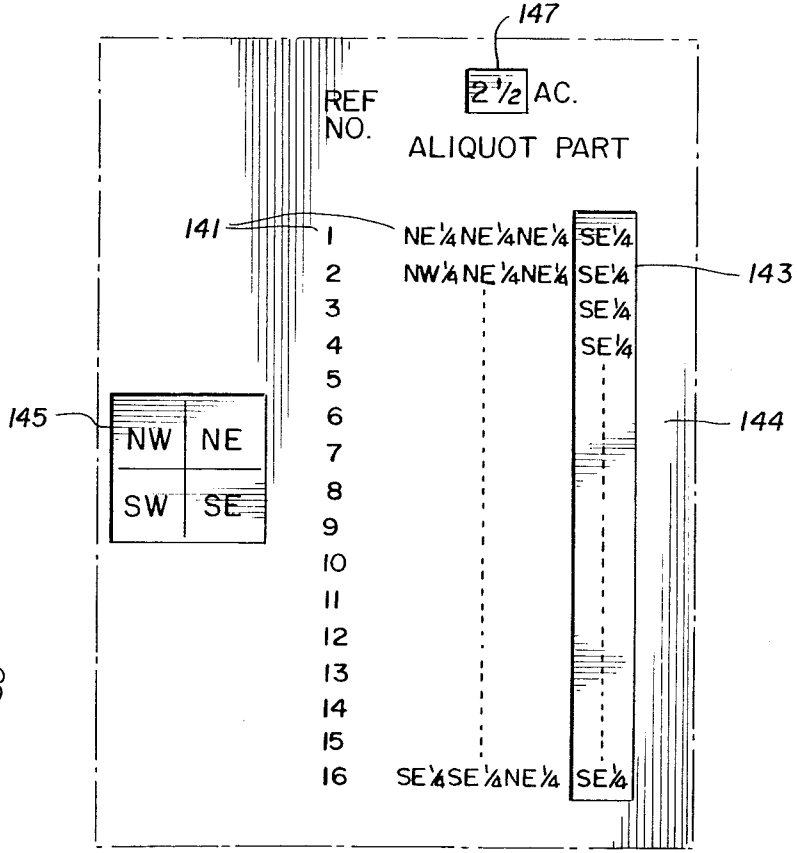
FIG. 8 is a detailed view of the area labelled "FIG. 8" in FIG. 1.
Figure 7:
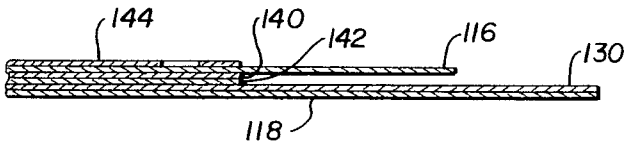
FIG. 7 is a cross-section taken along line 7—7 of FIG. 1.
Figure 9:
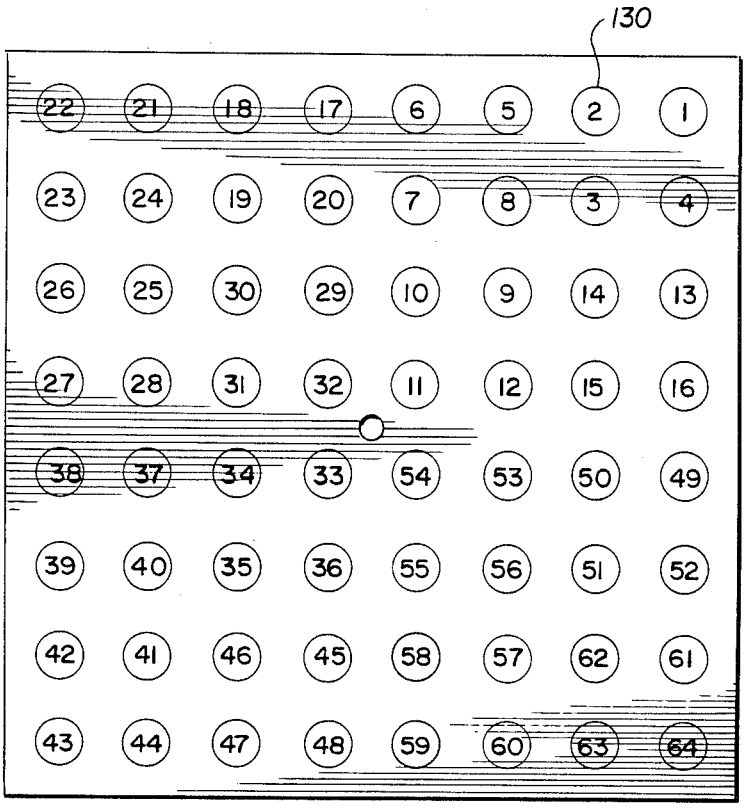
FIG. 9 is a plan view of the front side of the sheet behind the lower disc.

The educational device 110 is comprised of two inner rotatable discs, lower disc 112 and upper disc 114 of different diameters made of sheet material placed between two non-rotatable layers of sheet material, one a front layer 116, the other a back layer 118. The lower and upper rotatable discs 112 and 114 rotate around a central pivot 120 at which is set a grommet or similar fastener 122. The non-rotatable front and back layers 116 and 118 are fixed in relation to each other and connected to the two rotatable discs by means of grommet or fastener 122. The non-rotatable front layer 116 is imprinted on its front surface with a diagram 124 representing a square mile of land (640 acres) (as represented by a section of land in the Public Lands Survey System of Townships and Ranges established by the U.S. Government) divided into 64 squares 126, 8 squares on a side, each of which represents 10 acres of land. Within the center of each of the 64 squares 126 is a circular cut-out opening 128. The non-rotatable back layer 118 is imprinted on its front surface 130 with 64 numerals, arranged in a predetermined order, numbered "1" through "64", which are located so that they correspond exactly with the 64 circular cut-out openings 128 on the front layer 116 in such a manner as to enable each numeral to be read through one of the 64 circular cut-out openings 128 when both non-rotatable layers 116 and 118 are in juxtaposition. A predetermined arrangement of nine approximately circular cut-out openings 132 and 134 on both of the rotatable discs 112 (top) and 114 (bottom) respectively, of non-identical arrangement to each other, permits the viewing of only one of the 64 numerals imprinted on the front surface 130 of the non-rotatable back layer 118 at a given time when the two rotatable discs 112 and 114 are disposed between the two non-rotatable layers 116 and 118 in a prescribed manner. Imprinted along the outer edges, 136 and 138 of the top surfaces of the upper and lower discs 114 and 112, respectively, are numerals from "1" through "64" arranged in a predetermined order in which the arrangement is non-identical on either disc. By turning the discs 112 and 114 so that the identical numeral appears on both of the discs in such a manner as to be aligned between two imprinted arrows 137 and 139, one such arrow 137 being imprinted on the non-rotatable front layer, the other arrow 139 being imprinted on the non-rotatable back layer, the numeral will be revealed within one of the 64 circular cut-out openings 128 on said front layer 116, the remaining 63 numerals being concealed by the 2 rotatable discs 112 and 114. The nine cut-out openings 132 and 134 located on each of said discs 112 and 114 interact in such a manner that only two of said cut-out openings 132 and 134, one on each disc, fully coincide when the above described process of aligning an identical numeral printed on both discs between two imprinted arrows is accomplished. A list 141 of the 10-acre aliquot part subdivisions, each of which is keyed to one of the 64 numbers referred to previously, is imprinted on the non-rotatable front layer 116.

A layer of movable sheet material 140 is disposed between non-rotatable front layer 116 and upper rotatable disc 114. Said layer is partly enclosed within a sheath-like device 142 of sheet material attached to the underside of front layer 116. Movable layer 140 is designed to facilitate the locating of $2\frac{1}{2}$ acre aliquot part subdivisions when used in conjunction with the subject educational device. The movable layer 140 has imprinted on it partial descriptions of land subdivisions which, when properly aligned within cut-out openings 143 on the face 144 of the non-rotatable front layer, provides complete descriptions of $2\frac{1}{2}$ acre aliquot part subdivisions. In addition, movable layer 140 has a provision 145 and 147 to indicate the reinterpretation of the section diagram imprinted on the non-rotatable front layer, which is beneficial when locating $2\frac{1}{2}$ acre aliquot parts. Movable layer 140 is limited in its movements to the range of useful information contained on it.

On the reverse side is an educational device comprised of one rotatable disc 148 composed of sheet material disposed between two non-rotatable layers of sheet material 116 and 118. The rotatable disc 148 rotates around a central pivot 120 at which is set a grommet or similar fastener 122. The non-rotatable front and back layers 116 and 118 are fixed in relation to each other and connected to the rotatable disc 148 by means of the grommet or fastener 122. The non-rotatable front layer 116 contains two cut-out openings 150 and 152, one, 150, which is representative of a section diagram and the other, 152, which provides for the names of aliquot part subdivisions. The "section diagram" cut-out opening 150 is covered by a sheet of transparent material 154 (plastic film) on which has been imprinted a set of lines 156 dividing the diagram into 16 units, 4 units on a side, each of which represents 40 acres. The rotatable disc 148 has imprinted on it (1) a number of solid-colored areas 158 corresponding to from 1 to 8 of the 16 units when viewed through the section diagram cut-out opening 150 on face of non-rotatable front layer, and (2) names of aliquot part subdivisions corresponding to those displayed within the section diagram cut-out opening. Said educational device provides for the location and identification of every standard 40-acre, 80-acre, 160-acre, and 320-acre aliquot part to be found in a standard 640-acre section of land.

To enable a better understanding, a typical set of instructions for the embodiment disclosed in the drawings is set forth below:

Directions For Locating $2\frac{1}{2}$-Acre Equilateral Aliquot Parts:

(1) Adjust the sliding card until the appropriate quadrant (last quarter of description) appears in the cut-out windows to the right of each of the 4 columns of aliquot part lists. For example, if you are looking for the "$NE\frac{1}{4}$ $NW\frac{1}{4}$ $NE\frac{1}{4}$ $SE\frac{1}{4}$", be sure that "$SE\frac{1}{4}$" appears within all of these 4 cut-out windows.

(2) The small square cut-out window just to the left of the aliquot part lists represents a section diagram. It is very important to remember that if one of the 4 quarters of this section diagram is displayed in *green*, then the larger section diagram above, with 64 squares, will represent *only* that quarter of the section, and not the entire section. Note that the "SE" quarter is displayed in green when you set "$SE\frac{1}{4}$" in the 4 cut-out windows mentioned above.

(3) To locate "$NE\frac{1}{4}$ $NW\frac{1}{4}$ $NE\frac{1}{4}$ $SE\frac{1}{4}$" after you have accomplished steps (1) and (2) above, find this description on the lists and note its reference number (ref. no.). Then proceed with the same instructions listed under "Directions" below. Note that there is a small cut-out window above each of the 4 lists which indicates the acreage of the aliquot parts listed. In this case: "21/2 AC."

(4) To locate only 10-acre aliquot parts, adjust the sliding card until you see a pattern of dots within the 4 cut-out windows adjoining the aliquot part lists. Notice that there are no green areas displayed in the small section diagram. The small windows above the aliquot part lists will show "10 AC." Proceed with the instructions found under "directions."

Directions (1) The section diagram is divided into 64 squares, each representing a 10-acre equilateral aliquot part.

(2) To locate any aliquot part, first select the appropriate reference number (ref. no.) from the list below the section diagram.

(3) Position the selected ref. no. on both dials of the locator so that they line up between the 2 pointer arrows. ( ►◄ ). The aliquot part will be identified on the section diagram by a red disc in the center of the correct aliquot part. The reference no. will also appear (in white numerals) upon the disc as a verification.

Directions for use of Reverse Side (1) The section diagram is printed on a clear plastic sheet and divided into 16 squares, each representing a 40-acre aliquot part.

(2) Turn the dial until one of the red-shaded areas lines up precisely *within* one or more of the squares of the section diagram. The various red-shaded areas represent every standard 40-, 80-, 160-, and 320-acre aliquot part to be found in a 640-acre section of land.

(3) The aliquot part(s) will be identified by name within the small window to the left of the section diagram.

A similar device may be used to accomplish the same results. This device would utilize color-coding to a large degree. The name of each component of a land description (e.g. "$NE\frac{1}{4}$") would appear along the edge of a single rotatable disc. A subdivision such as "$SE\frac{1}{4}$ $NW\frac{1}{4}$ $NE\frac{1}{4}$" would require the use of three separate rotatable discs, which in turn would have to be color-coded. While this method would eliminate aligning two identical numerals between arrows, it would probably be more difficult to use this device and it would be impractical for color-blind individuals.

This device is primarily composed of layers of sheet material plus a grommet or fastener to hold the several layers in place. Lightweight cardboard is probably the most practical sheet material for this purpose, although thin plastic layers could also be used. Where necessary, transparent plastic film could be used over the cut-out openings.

Obviously, other alternatives employing the invention may be used within the scope of the appended claims. The disclosed embodiment is not intended to limit the invention in any manner.

What is claimed is:

1. A device for locating aliquot parts of a parcel of land, said device comprising a first rotatable disc a second rotatable disc of a different size than said first disc said first and second discs being mounted between front and back layers of sheet material, said first and second discs being rotatable relative to said sheet means about an axis passing through the geometric center of each disc;

said first disc having a pattern thereon formed by a plurality of holes therethrough;

said second disc having a pattern thereon formed by a plurality of holes therethrough;

said first and second discs each having a plurality of reference numbers located about the outer peripheral edge of each disc, each reference number corresponding to an aliquot part of a parcel of land, said aliquot parts being of equal area;

said front layer having a drawing corresponding to said parcel of land, said drawing having a pattern of lines drawn thereon representing lines dividing said parcel of land into said aliquot parts of equal area, each section of said drawing representing an aliquot part of said parcel of land having means defining a hole extending therethrough;

means on said sheet material for allowing the alignment of said reference numerals located about the outer peripheral edges of said sheets, in a predetermined position relative to a point on said sheet material;

said back layer of said sheet material having reference numerals corresponding to said reference numerals on said front and back disc located on a front side thereof;

means for assigning a reference numeral to each aliquot part of said parcel;

said front and back layers of sheet material and said discs being arranged so that, when said discs are rotated, at least one reference numeral on said outer peripheral edge of said first disc is aligned along the radius defined by said at least one reference numeral on said outer peripheral edge of said first disc and said geometric center with the corresponding reference numeral of same value on said second disc to form matching reference numerals and further said matching reference numerals are in said predetermined position relative to said sheet means, said patterns of holes on said first and second discs align so that one and only one of said reference numerals on the front of said back layer is visible through said holes in said front layer, said visible reference numeral being of the same value as said matching reference numerals, and the position of said hole in said front layer through which said one reference on the front of said back layer is visible corresponds to the location on said drawing of said aliquot assigned said reference numeral.

2. The device of claim 1, further including means on the back of a sheet behind said lower disc for indicating the location of each 40, 80, 160 and 320 acre aliquot part of a 640 acre section of land.

3. The device of claim 1, wherein said aliquot parts are squares.

4. The device of claim 3, wherein said drawing is a large square divided by said lines into 64 smaller squares.

* * * * *